US011028635B2

(12) United States Patent
Mack et al.

(10) Patent No.: US 11,028,635 B2
(45) Date of Patent: Jun. 8, 2021

(54) FIREARM SAFETY DEVICE

(71) Applicant: Hornady Manufacturing Company, Grand Island, NE (US)

(72) Inventors: Matthew Mack, Grand Island, NE (US); Thomas Delattre, Stuart, FL (US)

(73) Assignee: Hornady Manufacturing Company, Grand Island, NE (US)

( * ) Notice: Subject to any disclaimer, the term of this patent is extended or adjusted under 35 U.S.C. 154(b) by 374 days.

(21) Appl. No.: 16/055,275

(22) Filed: Aug. 6, 2018

(65) Prior Publication Data

US 2018/0356172 A1 Dec. 13, 2018

Related U.S. Application Data

(63) Continuation-in-part of application No. 15/333,927, filed on Oct. 25, 2016, now Pat. No. 10,233,687, which is a continuation-in-part of application No. 14/174,527, filed on Feb. 6, 2014, now Pat. No. 9,530,266.

(60) Provisional application No. 62/542,086, filed on Aug. 7, 2017, provisional application No. 61/761,610, filed on Feb. 6, 2013.

(51) Int. Cl.

| | |
|---|---|
| ***E05G 1/00*** | (2006.01) |
| ***F41C 33/06*** | (2006.01) |
| ***G07C 9/00*** | (2020.01) |
| ***F41A 17/54*** | (2006.01) |
| ***F41A 17/06*** | (2006.01) |
| ***E05G 1/04*** | (2006.01) |

(52) U.S. Cl.

CPC ..... *E05G 1/005* (2013.01); *E05G 1/04* (2013.01); *F41A 17/066* (2013.01); *F41A 17/54* (2013.01); *F41C 33/06* (2013.01); *G07C 9/00912* (2013.01)

(58) Field of Classification Search

CPC .... E05G 1/00; E05G 1/02; E05G 1/04; E05G 1/005; G07C 9/00182; G07C 9/00912; G07C 2009/00206; G07C 2009/0096; G07C 2009/00984; F41C 33/00; F41C 33/02; F41C 33/06; F41A 17/54; F41A 17/066

See application file for complete search history.

(56) References Cited

U.S. PATENT DOCUMENTS

| | | | |
|---|---|---|---|
| 1,240,981 | A | 9/1917 | Kohl |
| 3,095,724 | A | 7/1963 | Truhon |
| 3,354,570 | A | 11/1967 | Rizzo, Jr. |
| 3,589,062 | A | 6/1971 | Desmond |
| 4,342,207 | A | 8/1982 | Holmes et al. |
| 4,470,277 | A | 9/1984 | Uyeda |
| 4,917,022 | A | 4/1990 | Ogasawara et al. |
| 4,964,286 | A | 10/1990 | Poyer |
| 5,010,751 | A | 4/1991 | Schwartz et al. |
| 5,056,342 | A | 10/1991 | Prinz |
| 5,060,583 | A | 10/1991 | Stinson |

(Continued)

*Primary Examiner* — Christopher J Boswell

(74) *Attorney, Agent, or Firm* — McHale & Slavin, P.A.

(57) ABSTRACT

A firearm storage safety device, such as a trigger lock, for use on a firearm to make the trigger inaccessible. The lock has both a mechanical means and an electronic means to effect unlocking of the device. The electronic means includes a motor start device to effect operation of the electronic means components. Both unlocking means operate a common latching assembly.

10 Claims, 18 Drawing Sheets

(56) References Cited

U.S. PATENT DOCUMENTS 5,111,199 A 5/1992 Tomoda et al.
5,161,396 A * 11/1992 Loeff ..... E05B 47/0002 109/59 T
5,170,919 A 12/1992 DeSantis et al.
5,236,086 A 8/1993 MacTaggart
5,280,755 A 1/1994 Batur
5,294,031 A 3/1994 Volpei et al.
5,374,919 A 12/1994 Zelka et al.
5,495,967 A 3/1996 Parton
5,579,909 A 12/1996 Deal
5,584,424 A 12/1996 Stava
5,621,996 A * 4/1997 Mowl, Jr. ..... F41A 23/18 211/64
5,632,166 A 5/1997 Wiersma
5,662,219 A 9/1997 Tschudy et al.
5,671,830 A 9/1997 Wood
5,687,896 A 11/1997 Clift
5,713,149 A * 2/1998 Cady ..... F41A 17/04 42/70.06
5,881,584 A 3/1999 Brunoski et al.
5,924,565 A 7/1999 Colee
5,943,888 A 8/1999 Lawson
5,967,393 A 10/1999 Clarke, III
6,209,250 B1 4/2001 Mills
6,279,359 B1 8/2001 Boisvert
6,293,207 B1 9/2001 Do
6,318,134 B1 11/2001 Mossberg et al.
6,405,861 B1 6/2002 Siler et al.
6,408,555 B1 * 6/2002 Sapia ..... F41A 17/06 42/70.07
6,570,501 B2 5/2003 Bushnell et al.
6,606,492 B1 8/2003 Losey
6,843,081 B1 1/2005 Painter
6,845,640 B2 * 1/2005 Loeff ..... E05B 53/003 109/45
6,876,756 B1 4/2005 Vieweg
7,143,913 B2 12/2006 Lindsey et al.
7,296,448 B1 11/2007 Shaw
7,434,427 B1 10/2008 Miresmaili
7,469,564 B1 12/2008 Shaw
7,537,117 B2 5/2009 Roesler
7,845,202 B2 12/2010 Padilla et al.
8,074,477 B1 12/2011 Weiche
8,104,313 B2 1/2012 Wolfe
8,157,181 B2 4/2012 Bates et al.
8,201,426 B2 6/2012 Heim et al.
8,826,704 B1 9/2014 Marshall
9,010,007 B2 * 4/2015 Chandler ..... F41A 17/54 42/70.11
9,428,114 B2 8/2016 Mothersele
9,530,266 B2 12/2016 Delattre et al.
9,534,867 B2 1/2017 Dunn et al.
10,253,529 B1 * 4/2019 McGinn ..... E05B 47/0001
10,330,436 B2 * 6/2019 Romeo ..... F41C 33/0272
2001/0010491 A1 8/2001 Marneweck et al.
2003/0001724 A1 1/2003 Willats et al.
2003/0167693 A1 9/2003 Mainini
2003/0217574 A1 11/2003 Meis
2005/0235711 A1 10/2005 Martin et al.
2006/0213239 A1 9/2006 Roatis et al.
2006/0283219 A1 12/2006 Bendz et al.
2007/0000965 A1 1/2007 Cannon, Jr.
2007/0018787 A1 1/2007 de Velasco Cortina et al.
2007/0257772 A1 11/2007 Marcelle et al.
2008/0047860 A1 2/2008 Shane
2008/0180211 A1 7/2008 Lien
2008/0256998 A1 10/2008 Mallian et al.
2008/0264309 A1 10/2008 Villiger
2009/0308116 A1 12/2009 Lambrou
2010/0025446 A1 2/2010 Eberle
2010/0171589 A1 7/2010 Haberli
2010/0194527 A1 8/2010 Loughlin et al.
2010/0236298 A1 9/2010 James et al.
2010/0243492 A1 9/2010 Bulthuis, Jr. et al.
2011/0162564 A1 7/2011 Heim et al.
2011/0174200 A1 7/2011 Bartel
2011/0247950 A1 10/2011 McGee
2011/0290837 A1 12/2011 Smith
2012/0152776 A1 6/2012 Camp
2012/0324968 A1 12/2012 Goren et al.
2013/0025511 A1 1/2013 Maxwell
2013/0055933 A1 3/2013 Markman et al.
2013/0133558 A1 5/2013 Andrews
2013/0134193 A1 5/2013 Mothersele
2013/0298616 A1 11/2013 Ullrich et al.
2014/0083338 A1 3/2014 McAlexander
2014/0116303 A1 5/2014 Mothersele
2014/0145819 A1 5/2014 Wall et al.
2014/0182489 A1 7/2014 Suggs et al.
2018/0335275 A1 * 11/2018 Mack ..... E05B 65/0075
2018/0372447 A1 * 12/2018 Hyde ..... G07C 9/00309

* cited by examiner

FIREARM SAFETY DEVICE

RELATED APPLICATIONS

In accordance with 37 C.F.R 1.76, a claim of priority is included in an Application Data Sheet filed concurrently herewith. Accordingly, the present invention claims priority to U.S. Provisional Application No. 62/542,086, filed Aug. 7, 2017, entitled, "Firearm Safety Device", which is a continuation-in-part of U.S. Nonprovisional patent application Ser. No. 15/333,927, filed Oct. 25, 2016, entitled, "HANDGUN MINI-VAULT", which claims priority as a continuation-in-part to U.S. Nonprovisional patent application Ser. No. 14/174,527, filed Feb. 6, 2014, entitled, "HANDGUN MINI-VAULT", now U.S. Pat. No. 9,561,266, issued Dec. 27, 2016, which claims priority to U.S. Provisional Patent Application No. 61/761,610, filed Feb. 6, 2013, entitled, "HAND GUN MINI-VAULT"; the contents of the above referenced applications are herein incorporated by reference in their entirety.

FIELD OF THE INVENTION

The present invention provides a safety device, such as an electronic trigger lock, for use on firearms. The device has a plurality of locking mechanisms.

BACKGROUND OF THE INVENTION

Safety devices, such as trigger locks, have been available for decades. They are used to make it difficult to use a firearm, typically for an unauthorized user. They are sometimes required by law and, in particular, to protect children.

There have been many types of trigger locks. Typically, they are mechanical in nature. One popular lock is made by Master Lock. It has two halves with a post that goes through the trigger guard. Each half has a cover that is large enough to cover the entire trigger guard and, while in place, prevent access to the trigger. Another popular lock is a cable lock that can be used on rifles, shotguns and self-loading pistols. The cable prevents the bolt or slide from operating. It does require that the breech be open, which can make the gun difficult to store.

Both of these forms of locks are fully mechanical and require a key to unlock and remove the lock. While providing storage safety, in the event of an urgent need to access a gun, say during a break in, one might not be able to find the key, or find it fast enough, and then affect unlocking and lock removal.

Small portable gun safes have also been provided, but can be obtrusive for discreet storage, have gun size restrictions, and cannot accommodate a handgun and a long gun.

Thus, there is a need for an improved trigger lock.

SUMMARY OF THE INVENTION

It is an objective of the present invention to provide a safety device, such as a trigger lock, that utilizes a dual lock configuration for securing the lock to a trigger guard.

It is a further objective of the invention to provide a trigger lock that combines a mechanical lock device and an electronic lock device to provide a plurality of opening modes.

It is a still further objective of the present invention to provide a trigger lock with an electronic lock that effects a complete release of the trigger lock from a gun with a remote electronic actuator.

The locking system of the present invention utilizes an electronic actuator, such as RFID technology, to allow authorized users to open the trigger lock by simply moving an RFID chip into proximity with an interrogator in the trigger lock.

Other objectives and advantages of this invention will become apparent from the following description taken in conjunction with any accompanying drawings wherein are set forth, by way of illustration and example, certain embodiments of this invention. Any drawings contained herein constitute a part of this specification, include exemplary embodiments of the present invention, and illustrate various objects and features thereof.

DETAILED DESCRIPTION OF THE INVENTION

Figure 1:
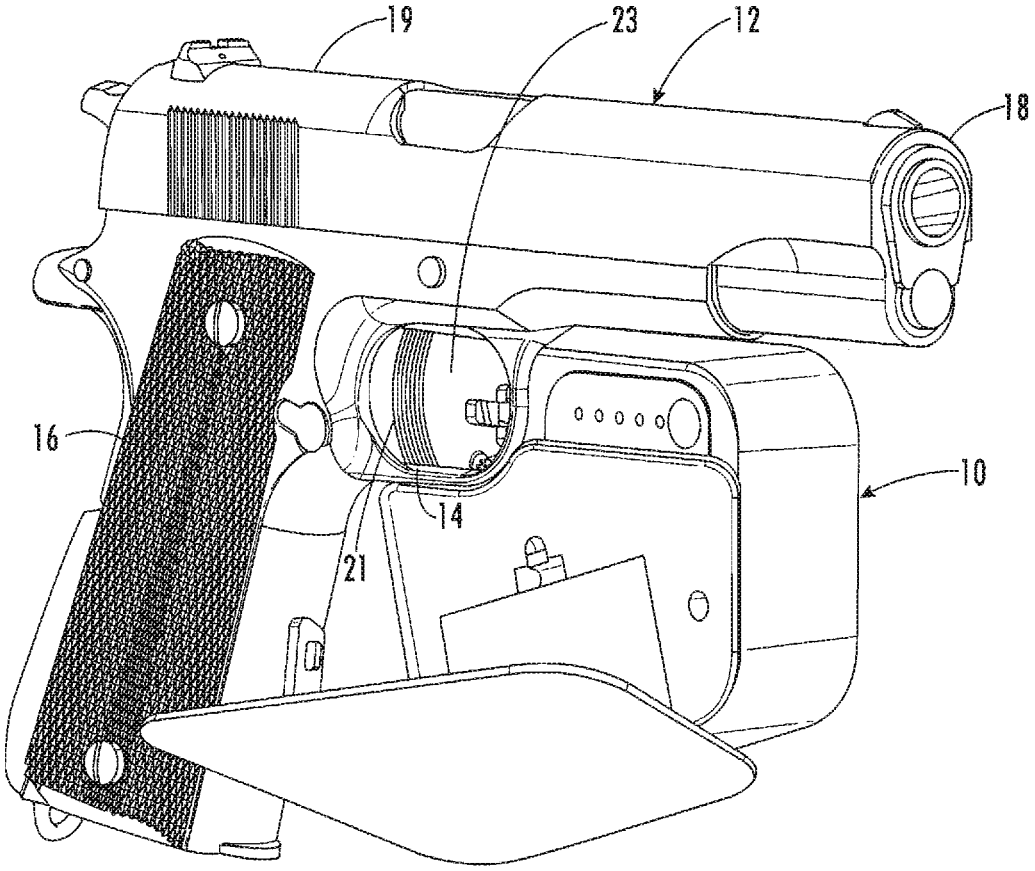
FIG. 1 is a perspective view of a trigger lock mounted to a handgun trigger guard with a portion of the lock device in a partial release condition.

While the present invention is susceptible of embodiment in various forms, there is shown in the drawings and will hereinafter be described a presently preferred embodiment with the understanding that the present disclosure is to be considered an exemplification of the invention, and is not intended to limit the invention to the specific embodiments illustrated.

The present invention will be described in detail as it relates to a trigger lock. However, it is to be understood and as will be described below, the latching mechanisms described herein can also be used with other gun safety devices, such as a pistol storage box.

The reference numeral 10 designates generally a trigger lock for cooperative association with a firearm, designated generally 12, to close its trigger guard 14 on opposite sides of the trigger guard 14 and provide an impediment to use of the firearm. While the firearm 12 is shown as a pistol, the trigger lock 10 can be utilized on a long gun, such as a rifle or shotgun, if desired. The illustrated firearm 12 is a self-loading pistol, sometimes referred to as a semi-automatic pistol; however, the invention is not limited to the use of the trigger lock 10 on a pistol. While the phrase "trigger lock" is used herein, these devices do not lock the trigger, but rather shield the trigger from access so that the trigger cannot be pulled when the trigger lock 10 is secured in place.

The firearm 12 includes a grip 16 in the form of a handle depending from a barrel assembly 18. In the illustrated structure, the barrel assembly 18 includes a slide 19, which is used for loading a first-round into the chamber. Forward of the grip 16 is the trigger guard 14, which includes a space for a trigger 21. There is a space 23 between the front part of the trigger guard 14 and the trigger 21 that is adapted to receive a finger therethrough for operation of the trigger. Trigger guards have generally the same shape and size; however, they do differ in some aspects. The trigger guard 14 can have parts (described below) shaped to be generic, semi generic or specific to a particular size and shape of trigger guard. A changeable insert for the trigger guard can be provided to accommodate a specific trigger guard size and shape (as described below). For example, the Glock trigger guard has a forwardly projecting horn on the forward bottom corner. But, typically, semi-automatic trigger guards are generally rectangular with the lower forward corner being curved both on the interior and exterior.

Figure 2:
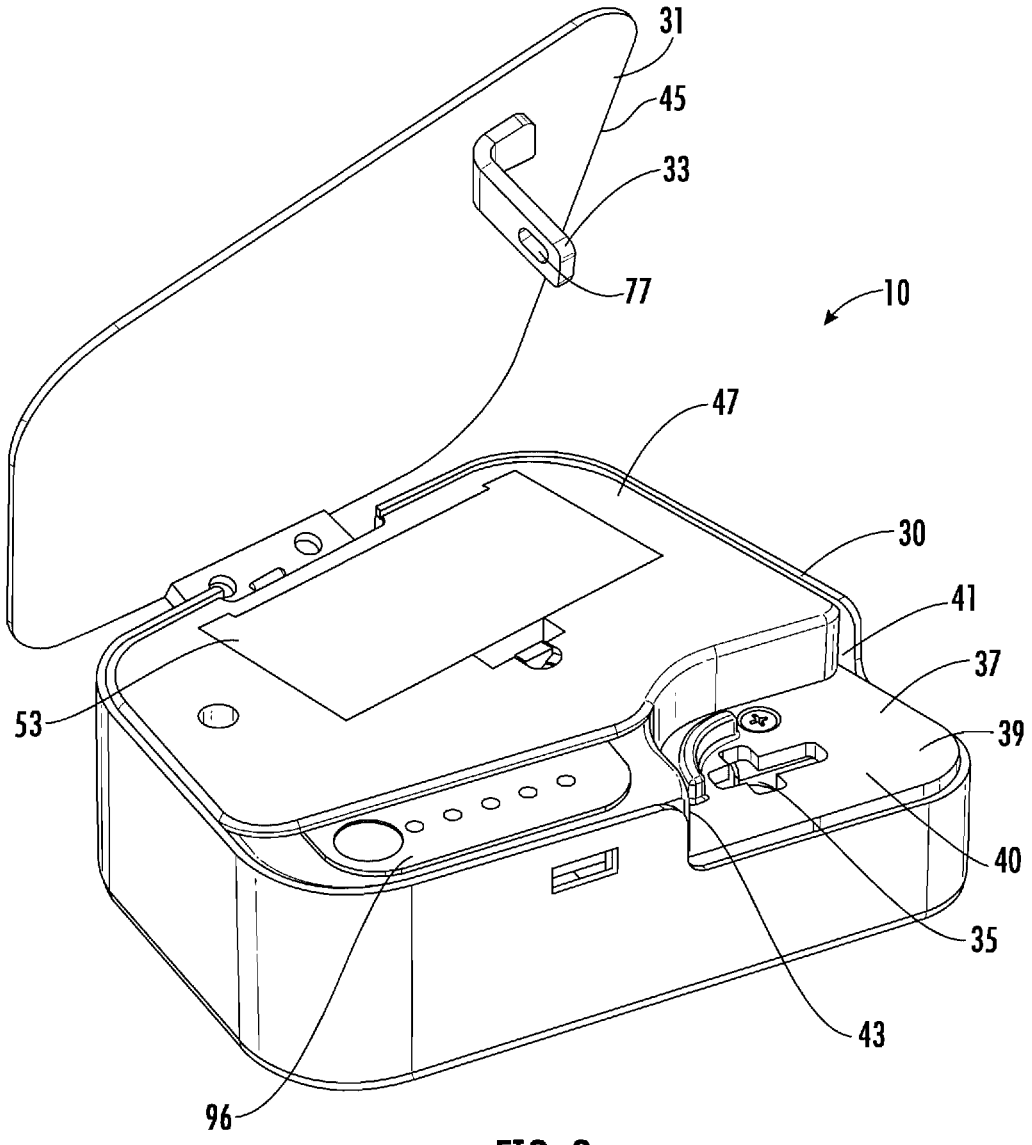
FIG. 2 is a perspective view of the trigger lock as seen in FIG. 1, but without a secured gun.
Figure 3:
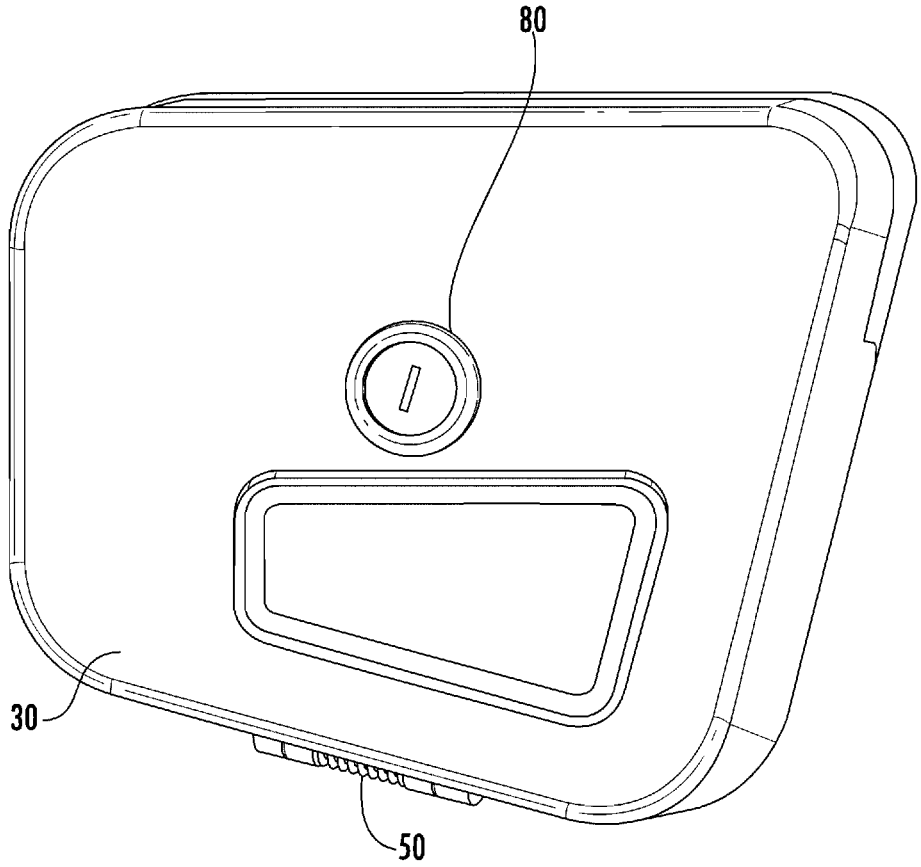
FIG. 3 is a rear plan view of the trigger lock.
Figure 4:
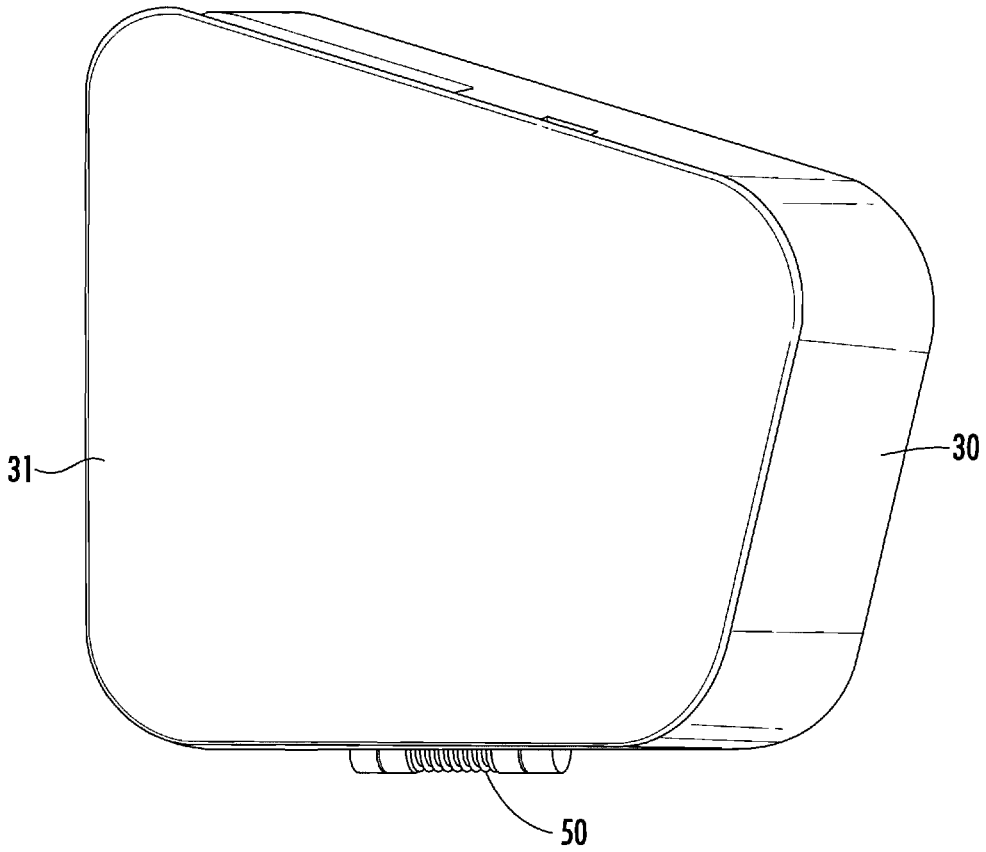
FIG. 4 is a front plan view of the trigger lock.

FIG. 2 shows a trigger lock 10. The trigger lock 10 has a housing including a base housing 30 and a movable cover 31 hingedly mounted thereto for movement between open and closed positions. In FIG. 2, the cover 31 is in an open position. In the illustrated structure, the cover 31 is provided with a catch member 33 mounted thereon and movable into and out of a receiver pocket 35 in the housing 30. The cover 31 is configured to be in overlying relationship to a trigger guard receiving recess 37 in the housing 30. As seen in FIG. 1, the trigger guard 14 is received within the recess 37 for securing the trigger lock 10 to the firearm 12. The recess 37 is defined by a generally planar wall 39 and a wall 41 that corresponds generally to the exterior shape of the trigger guard. A rib 43 projects from the wall 39 and is spaced from the wall 41 sufficiently for the trigger guard 14 to be received in the groove formed between the wall 41 and rib 43. The walls 39, 41 and rib 43 can be made removable to provide ribs and recesses 37 of different sizes and shapes to accommodate different sizes and shapes of trigger guards. The pocket 35 opens on the wall 39. The rib 43 helps align the firearm 12 relative to the trigger lock 10 for securing the trigger lock to the firearm. The cover 31 has an inner surface 45 that overlies the wall 39 and a surface 47 of wall 39 when the cover 31 is in a closed position. This configuration forms a trigger guard receiving receptacle 40 between the surface 45 and the walls 39, 41. The trigger lock 10 has a cavity in the housing 30 for containing mechanisms to retain the cover 31 in its closed position and a source of electrical energy, such as a battery 69. As seen in FIGS. 3, 4, the cover 31 can be mounted on a hinge pin operably associated with a torsion spring 50 so that, when unlatched, the cover can move from a closed position as seen in FIGS. 3, 4 to an open position as seen in FIGS. 1, 2. The spring 50 resiliently biases the cover 31 to its open position, and will move the cover to that position from the closed position. As also seen in FIG. 2, the housing 30 can be provided with a selectively openable access door 53 to expose an electrical energy source, such as a battery 69 contained in the housing 30.

The locking system 59 of the present invention is operable electronically and mechanically. The electronic section can utilize RFID technology (radio-frequency identification) to allow authorized users to open the trigger lock 10 by simply moving an RFID tag 60 into proximity with an interrogator 62 (sometimes called a reader) in the trigger lock, see FIG. 5. The trigger lock 10 can also be released by a mechanical means, such as a key lock system 64 using a manual lock actuator. The RFID tag 60 is preferably embedded into a portable device 66 such as a wrist band, key fob, ring, decal or the like. The device 66 could also be actuated by an actuator 68, such as a push button, instead of being in proximity to an RFID. The interrogator 62 can be configured to accept a plurality of input codes or accommodate a plurality of different RFID tags or radio frequency transmitters. While an RFID system is described, any device operable to provide a signal to operate the locking system can be used. For example, a biometric sensor could be used to identify an approved user to effect unlocking and opening. Such biometric sensors can be voice, fingerprint, face scan, eye scan and the like. They can be configured to operate on different input signals, for example, different voices or fingerprints to allow different users operating privileges.

The present invention provides a dual, mechanical and electronic, cover opening system which releases the firearm 12 from the trigger lock 10, making it available for use. The trigger lock 10 preferably utilizes an internal electrical source, such as a battery 69, such as a rechargeable and an associated recharging circuit, to provide portability to the device; however, standard electrical current may be utilized without departing from the scope of the invention. The device could also include a power switch or a sleep mode which activates the interrogator for the RFID for a predetermined amount of time to conserve battery power. The locking system 59 is contained in the housing 30.

Figure 5:
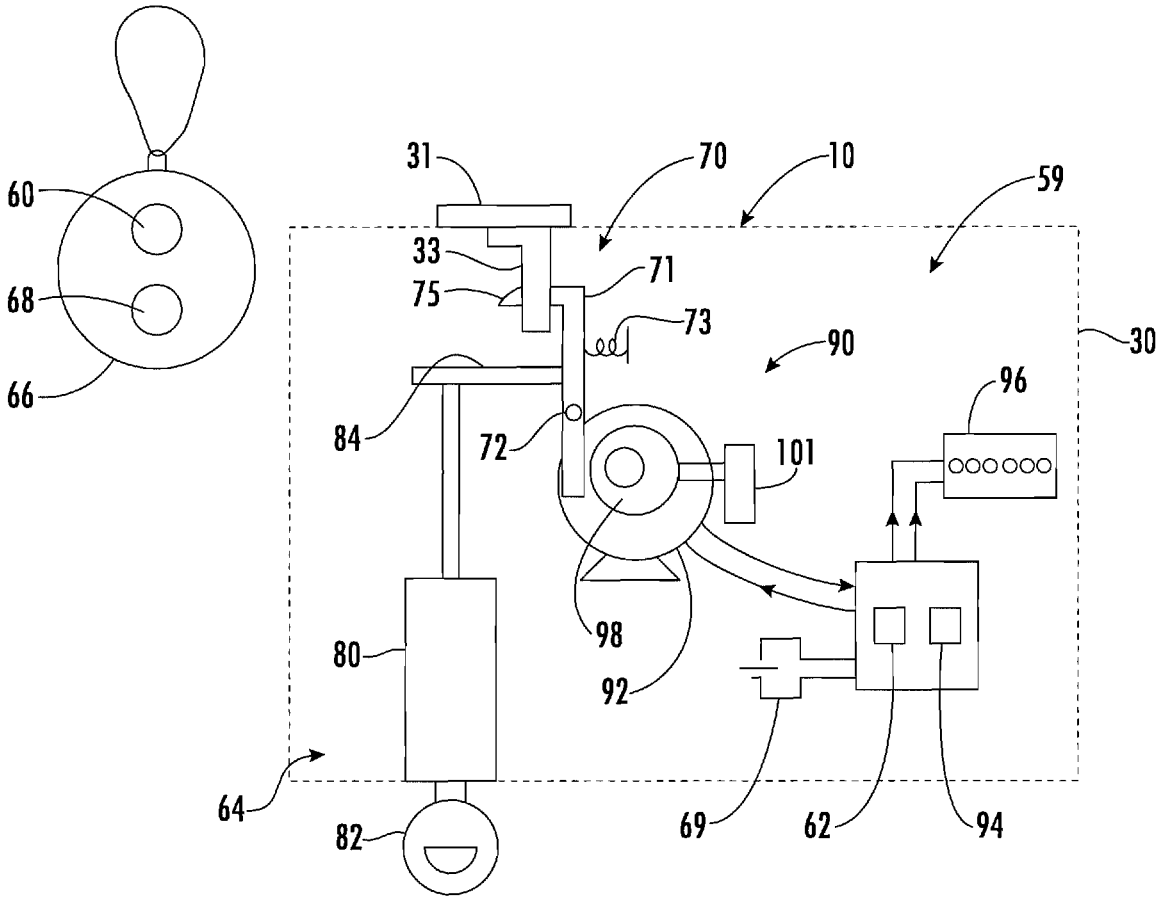
FIG. 5 is a schematic illustration of mechanisms contained in the trigger lock housing for operating locking mechanisms.

The locking system 59 includes a dual catch release mechanism, one electronic and one mechanical, using a common latch assembly 70. The catch member 33 is part of the latch assembly 70, and is secured to the cover 31 and movable therewith. The latch assembly 70 also includes a latch 71, which is movably mounted to a suitable support structure and is biased to a latch position, preferably with a resilient member such as a compression spring 73. As shown, the latch 71 is pivotally mounted on a pin 72 that is secured to the housing 30. The latch position is illustrated in FIG. 5. As shown, the latch 71 has a finger 75 that is selectively movable into and out of a catch slot 77 (FIG. 2) in the catch member 33. The locking system 59 includes a mechanical lock actuator including a key lock system 64 that includes a key cylinder 80 mounted in the housing 30 and accessible from the exterior by a key, as seen in FIG. 3. To operate the key lock, a key 82 is inserted into the cylinder 80, which allows an arm 84 or the like to be moved into engagement with the latch 71, and move the latch such that the finger 75 exits the slot 77, releasing the cover 31 from retention, thereby allowing the cover 31 to move to an open position under the bias of the spring 50. The firearm 12 is then available.

The cover 31 can also be opened electronically as an optional opening mode. Referring to FIG. 5, the electronic retainer/release assembly is illustrated. The locking system 59 is generally constructed and arranged to operate the latch assembly 70 to cause the cover 31 to open in response to communication with an RFID tag 60. The latch assembly 70 can be released electrically by an electrically operated release assembly 90 that, as shown, includes an electric motor 92 mounted in the housing 30. The motor 92 is in electrical communication with a controller circuit 94 and a control panel 96. The control panel 96 may be user accessible from the housing 30 exterior (not shown). The motor 92, in the preferred embodiment, includes an internal gear reduction, which reduces output shaft speed and increases output torque of the motor. The output shaft of the motor has a cam 98 mounted thereon and rotatable thereby. Upon rotation of the cam 98, the latch 71 moves and the finger 75 exits the slot 77, releasing the cover 31 from retention, thereby allowing the cover 31 to move to an open position under the bias of the spring 50. The firearm 12 is then available. Upon rotation of the cam 98, and after the cover is released, the cam actuates a switch 101 which terminates power to the motor 92 and stops its rotation, as well as that of the cam 98, leaving the finger 75 in its withdrawn position. The switch being actuated can also effect reverse rotation of the motor 92 to return the cam 98 to its start position. Alternatively, a code can be entered on the control panel 96 to effect rotation of the motor 92 and cam 98 back to their start position, allowing the latch 71 to return to its latch position under influence of the spring 73. The cover could then be closed and latched in the closed position.

The access code for the control panel 96 can be programmable after purchase if desired. Also, if desired, the control panel 96 could be accessible when the cover 31 is closed to allow for entry of the code to effect electrical opening of the cover 31 without the key 82 or the device 66.

The walls 39, 41, the rib 43, and the catch 33 can be coated with a material, such as plastic or an elastomer, to provide a mar resistant finish if they are not already mar resistant.

Figure 6:
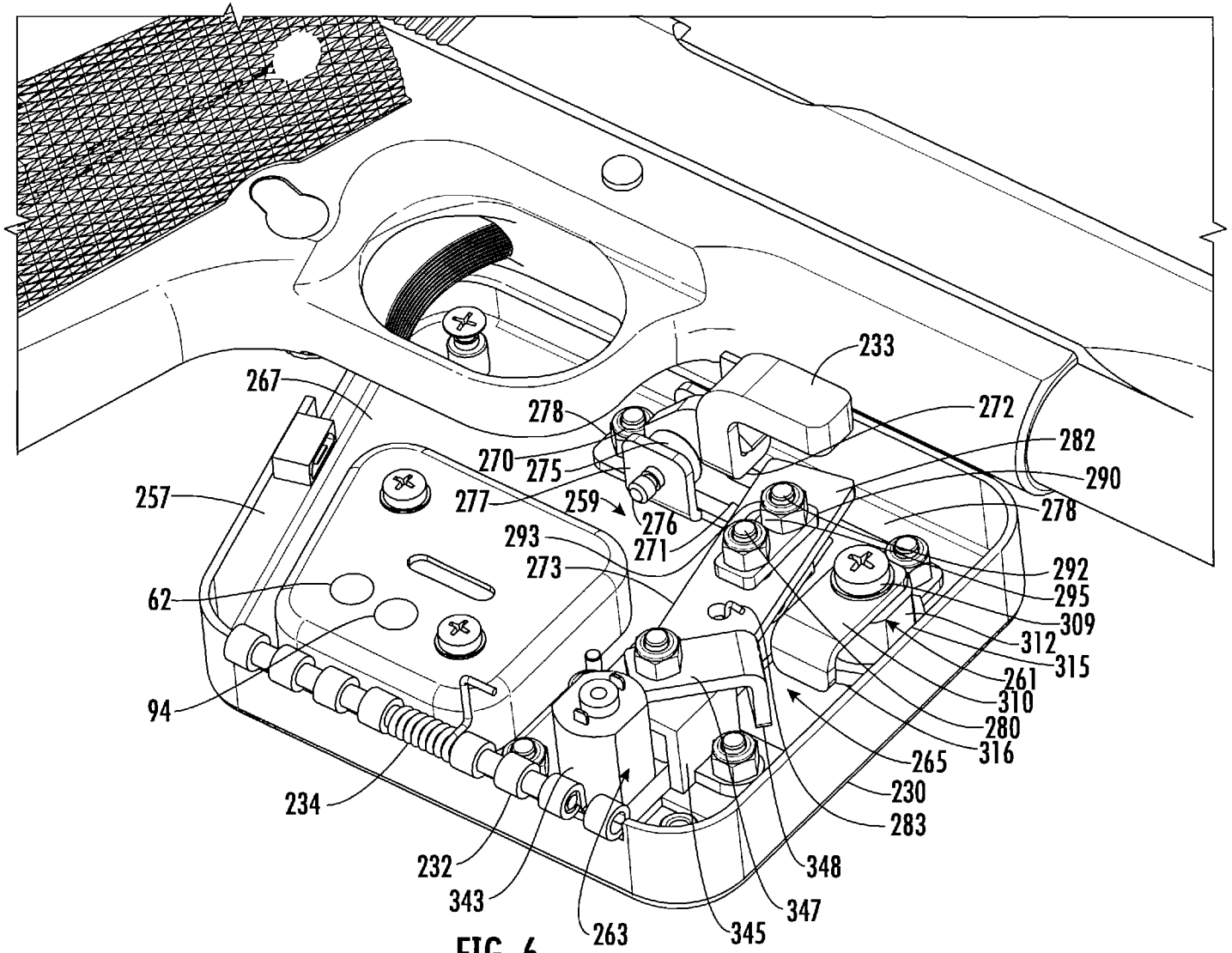
FIG. 6 is a perspective view of a second form of latching mechanism for the trigger lock.
Figure 7:
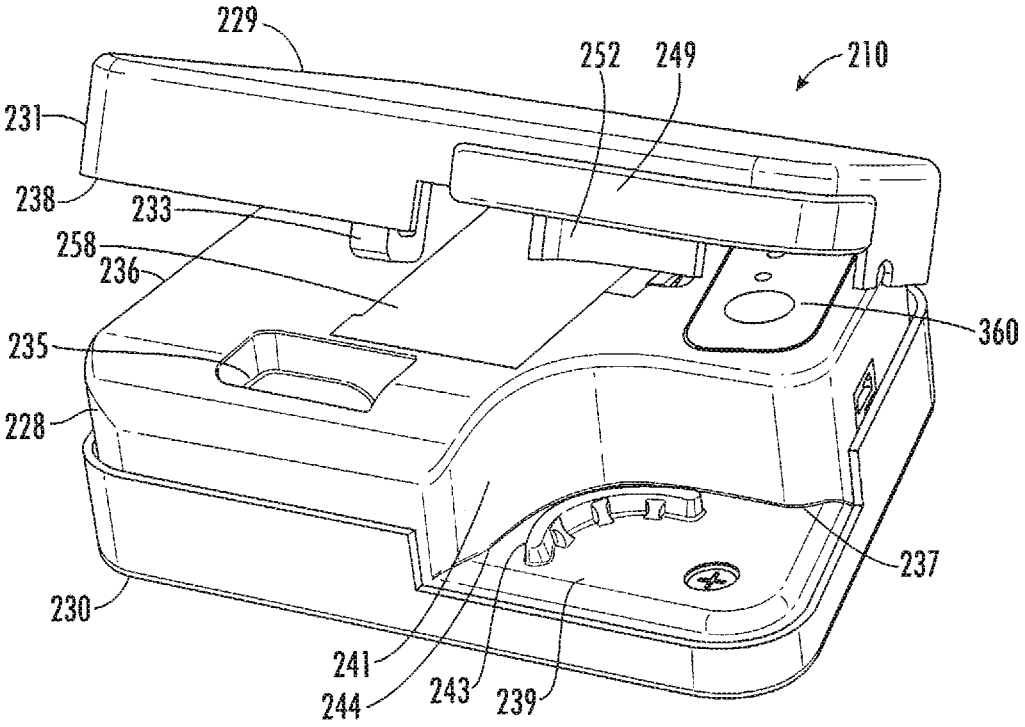
FIG. 7 is a perspective view of the second form of trigger lock housing and cover.

FIGS. 6-7 show a modified form of trigger lock 210 with a locking system 259 with a dual lock release mechanism, one electronic and one mechanical.

The trigger lock 210 includes a housing that has a base housing 230 and a movable cover 231 hingedly mounted via hinge 232 thereto for movement between open and closed positions. A torsion spring 234 is provided to cooperate with the housing 230 and cover 231 to resiliently bias opening movement of the cover 231 relative to the base 230. In FIG. 7, the cover 231 is in an open position. In the illustrated structure, the cover 231 is provided with a catch member 233 mounted to a main panel 229 thereof and movable into and out of a receiver pocket 235 in the housing 230. The cover 231 is configured to be in overlying relationship to a top panel 236 and a trigger guard receiving recess 237 in the housing 230. The cover 231 has a sidewall 238 extending from a main panel 229 about the peripheral edge thereof, forming a peripheral skirt. The sidewall 238 is sized and shaped to be received over a sidewall 228 of the housing 230 except at the recess 237. The pocket 235 opens onto the panel 236 and is positioned under the cover 231 when it is in its closed position. The trigger guard 14 is received within the recess 237 for securing the trigger lock 210 to the firearm 12. The recess 237 is defined by a generally planar wall 239 and a wall 241 that corresponds generally to the exterior shape of the trigger guard 14 to limit movement thereof in the recess 237. A rib 243 projects from the wall 239 and is spaced from the wall 241 sufficiently for the trigger guard 14 to be received in the groove 244 formed between the wall 241 and rib 243. The rib 243 helps align the firearm 12 relative to the trigger lock 210 by extending into the inside of the trigger guard 14 and securing the trigger lock to the firearm when the cover 231 is closed. The cover 231 has an inner surface (not shown) that overlies the wall 239 and the panel 236 when the cover 231 is in a closed position. This configuration forms a trigger guard receiving receptacle between this inner surface and the walls 239, 241. A bead 249 is part of the cover 231 and extends toward the wall 239 and is positioned on the outer perimeter of the recess 237. The bead 249 is operable to restrain movement of the trigger guard 14 and the firearm 12 when the trigger lock 210 is secured to the firearm, and can be made of a polymeric or elastomeric material to protect the finish on the firearm 12. The bead 249 is made separately, and is suitably secured to the sidewall 238 of the cover 231. The cover 231 can also be provided with a rib 252 projecting therefrom. The rib 252 is similar to the rib 243; and when the cover 231 is closed, the rib 252 overlies the rib 243 and is received inside the trigger guard 14 to assist in retaining the firearm 12 secured in the trigger lock 210.

The trigger lock 210 has a cavity 257 in the housing 230 for containing the locking system 259 that releasably retains the cover 231 in its closed position and a source of electrical energy, such as a battery. The housing 230 can be provided with a selectively openable access door 258 to expose an electrical energy source, such as a battery contained in the housing 230.

The trigger lock 210 is provided with a locking system that includes a plurality of components. It includes a manual lock mechanism or actuator, designated generally 261, an electronic release assembly or actuator, designated generally 263, and a latch assembly designated generally 265. The mechanisms 261, 263, 265 cooperate with one another to effect locking the cover 231 in a closed configuration to retain the firearm 12, and unlocking the cover 231 to allow it to move to an open position and release the firearm.

The latch assembly 265, is secured to a main panel 267 of the housing 230. The latch assembly 265 includes a latch member 270. The latch member 270 is a pivotally mounted hook having a throat 271 with a foot 272 positioned to selectively extend under a pawl member 273 described below. When the cover 231 is locked in the closed configuration, the latch member 271 is engaged with the catch 233 extending through pocket 235. The latch member 270 is biased to a release position, pivoted outwardly, as with a torsion spring 275 mounted on a latch pivot pin 276. The movement of the latch member 270 for opening, i.e., outwardly, is in opposite directions of the movement for latching, i.e., inwardly. The pivot pin 276 is mounted to a respective pair of spaced apart arms 277 integral with and extending from a latch base 278. The latch base 278 is secured to the panel 267 of the housing 230 in any suitable manner, as by welding or mechanical fasteners.

The pawl member 273 is pivotally mounted to the latch base 278 with a pivot pin 280. The pawl member 273 includes an arm 282 associated with the latch member 270 for releasably retaining the pawl member in a latching position as seen in FIG. 6. A resilient biasing member, such as a torsion spring 283, is mounted on the pin 280 and resiliently biases the pawl member 273 to its latching position as seen in FIG. 6. The foot 272 of latch member 270 engages a side of the arm 282 under biasing force influence of the spring 283 to releasably retain the pawl member 273 in its unlatched position. The foot 272 is also positioned under and engages the arm 282 to releasably hold the latch 270 in its lid closed retaining position.

A hold down retainer 290 is mounted to the base 278 and overlies the pawl member 273 to force it to pivot in a plane and not rock on the pivot pin 280, and thus ensure it is not interfering with the pawl member 273 moving to its latching position, as seen in FIG. 6. As shown, the retainer 290 is mounted on the pivot pin 280 and a post 292 secured to the panel 267, and held in place by mechanical fasteners 293, such as threaded nuts. The pawl member 273 is provided with a slot 295 receiving a post 292 therethrough. The slot 295, in cooperation with the post 292, limits pivoting movement of the pawl member 273. The pawl member 273 thus moves in a plane in a limited reciprocating manner like the latch 71. This plane of movement is generally parallel (say within +/−20°) to the panels 229, 267 when the cover 231 is closed, and generally normal to the plane of pivoting movement of the latch member 270, that is close enough to normal, that the pawl member 273 moves into and out of the throat 271 without functional interference.

The latch assembly 265 cooperates with a plurality of operation actuators. One is an electronic actuator 263, and one is a mechanical actuator 261. The mechanical actuator 261 includes a lock output arm 310 pivotally mounted on a mechanical lock 312 with a retainer 309. The mechanical lock 312, preferably a key lock of a tubular or barrel style, is mounted to base housing 230 and is keyed thereto to prevent rotation relative to the base housing 230. It has a lock cylinder 315 with an output shaft (not shown) that can be rotated by operation of a key 82. A lock output arm 310 is fixed to the lock output or drive shaft and rotatable therewith. Preferably, the arm 310 is keyed to the lock output shaft to prevent relative rotation. When the cover 231 is closed, the arm 310 has a finger 316 that will engage an edge of the pawl member 273 to selectively effect its rotation, clockwise as seen in FIG. 6. In response, movement of the arm 310 will rotate the pawl member 273 out of latching engagement with the latch member 270, allowing the spring 275 to move the latch member out of retaining engagement with the catch 233, allowing the cover 231 to open. This opening mode can be used as an override to the electronic actuator 263. Closing of the cover 231 will move the free end of the catch 233 into engagement with the foot 272 of the latch member 270 at a position beyond the end of the arm 282 to effect its pivoting against torque from the springs 275, and allow the arm 282 to move back over the foot 272 of the latch 270 automatically under the influence of the spring 283, locking the cover 231 in its closed position.

The electronic lock actuator 263 is preferably initiated wirelessly, such as with a radio frequency device, or preferably using an RFID interrogator 62 in combination with an RFID tag 60. Such a system, a locking system 59, is described above in reference to the first embodiment. A biometric sensor arrangement could also be used. An RFID tag 60 can be on a wrist band, in a key fob, or in a decal form attached to a device such as a cell phone, and can couple wirelessly with an interrogator 62 which is coupled to a controller circuit 94. The RFID tag 60 can be part of a portable device 66 having an actuating pushbutton 68. In addition to a wireless signal operation, the actuator 263 can be provided with a touch pad 96 to enter a code that, if correct, will also effect opening of the cover 231 as described herein. The touch pad 96 can be accessible on the base 230, the cover 231, or through an opening in the cover 231. The actuator 263 can be configured to accept a plurality of input codes or accommodate a plurality of different RFID tags or radio frequency transmitters. Biometric sensors could also be used to identify an approved user to effect unlocking and opening. The actuator 263 includes a source of electricity, such as a battery power supply 69 operably associated with an electronic controller 94. A battery condition indicator 360 can also be provided. The controller 94 and battery 69 are operably coupled to one another and to motor 343 via a communication cable (not shown). A plug in AC power supply, such as a transformer, can also be provided to reduce battery usage and allow the actuator 263 to be in a continuous power on mode. Further, the actuator 263 can be configured to turn off manually or automatically to conserve batteries. The actuator 263 can provide an indicator, such as an LED light, to indicate if the actuator is powered on with either AC or battery. Such an indicator can also show if the actuator 263 needs to be turned on, if in battery saving mode, and provide a touch sensing switch means to effect powering the actuator 263 for opening the trigger lock 210. The motor 343 can include a gear drive, such as a right angle drive output device 345. The drive output device 345 includes an actuator arm 347 that is ultimately driven by the motor 343. The arm 347 includes a finger 348 that is operable to effect pivoting movement of the pawl member 273 to its unlatched position, and release the cover 231 to open. Closing of the cover 231 is effected as described above. Means is provided to positively stop the motor 343 and effect reverse rotation of the motor 343 and the arm 347 when the latch 270 is released. A switch system, like switch 101, is mounted to the housing 230 and has an actuator that is positioned to engage either the pawl member 273, arm 347 or finger 348 when the pawl member 273 has moved to its unlatched position. When engaged, the switch provides a signal to the controller 94 and effects power feed to the motor 343 to effect its reverse rotation, which moves the arm 347 and finger 348 back to their normal position for locking the cover 231 and allowing the pawl member 273 and latch 270 to return to their latching positions. A second switch 101 can be positioned to turn off power to the motor 343 and tell the controller the next activation will be to effect unlatching. The latch mechanism 265 is now configured for closing and locking the cover 231. A stepping motor, an encoder and/or a motor load sensor could be used to effect reversal and stopping of the motor 343.

The panel 236 is provided to shield the latch mechanism 265, power supply 69, motor 343, and drive 345 from contact with a contained firearm 12.

FIGS. 8-17 illustrate a still further embodiment of the present invention. It is particularly well adapted for use in safety devices that have limited space, such as trigger locks. A trigger lock 400 is shown mounted to a pistol 12, and is constructed to resist access to the trigger 21 of the pistol 12.

Figure 8:
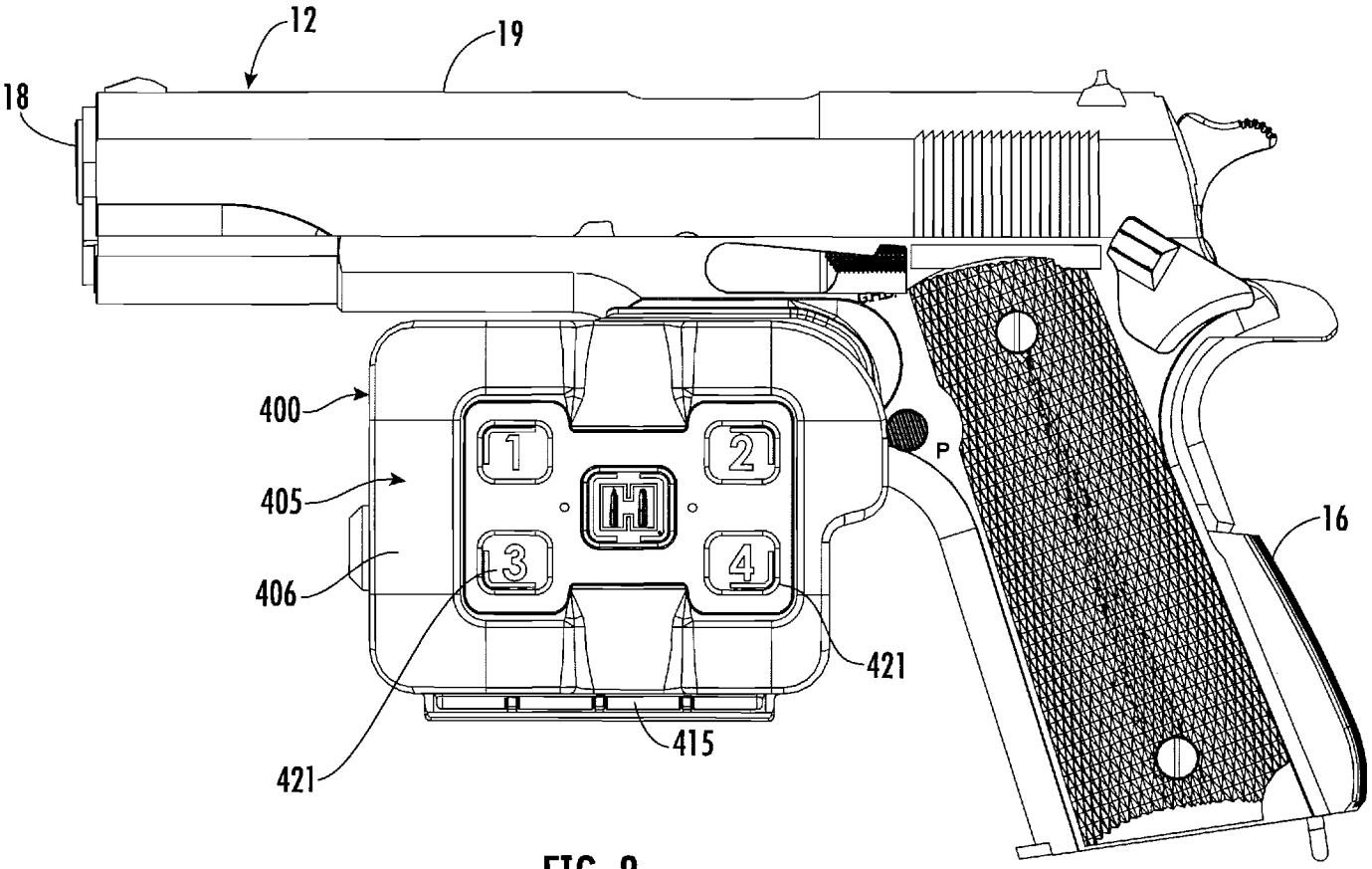
FIG. 8 is a side elevation view of another form of trigger lock associated with a firearm.
Figure 9:
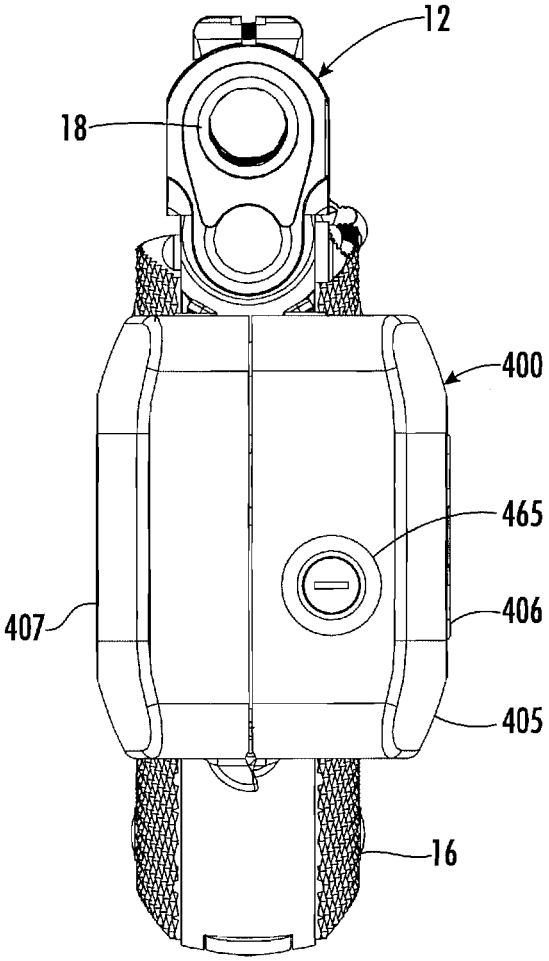
FIG. 9 is a front view of the trigger lock housing of FIG. 8.
Figure 10:
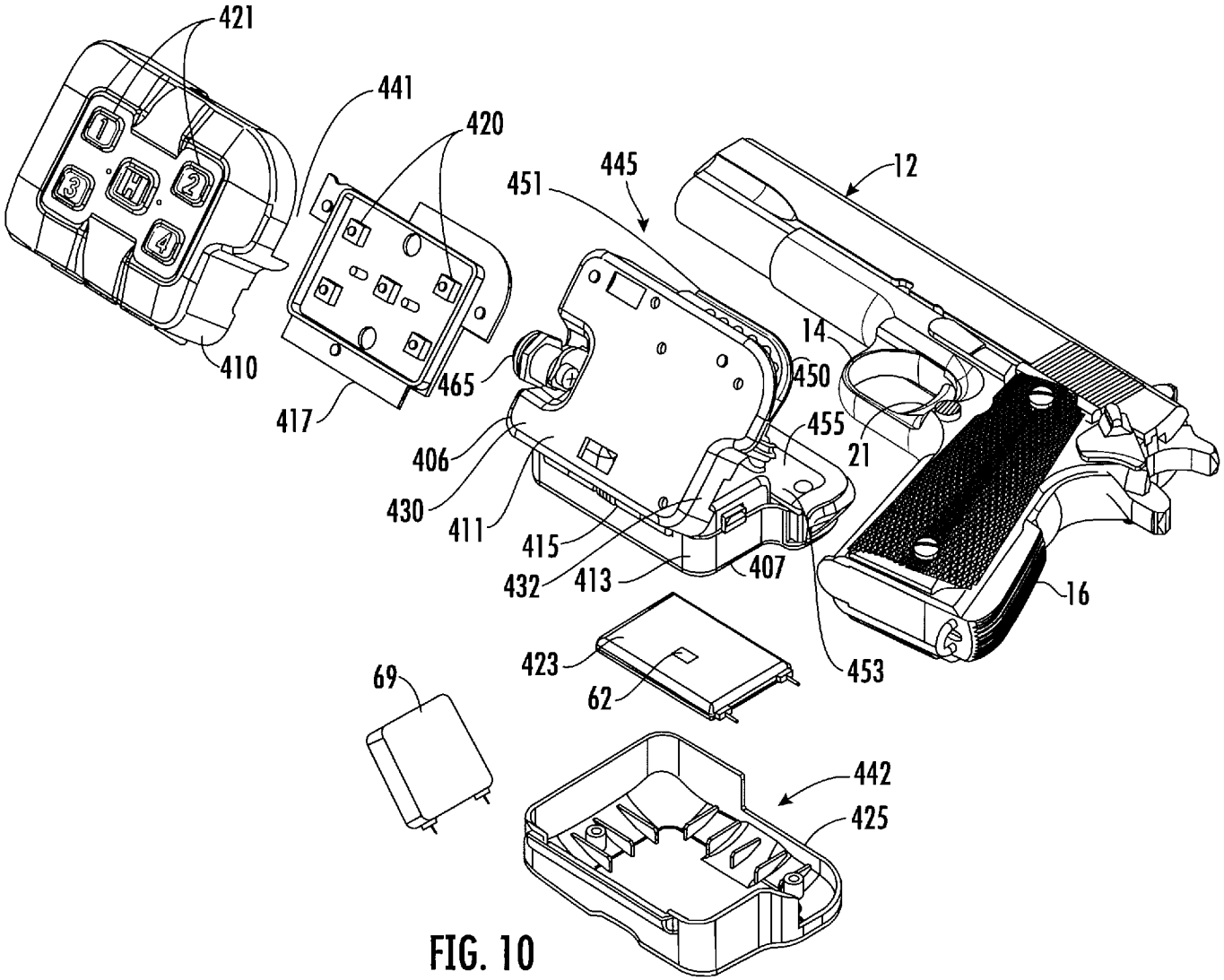
FIG. 10 is an exploded perspective view of the locking system of the trigger lock of FIG. 8.
Figure 11:
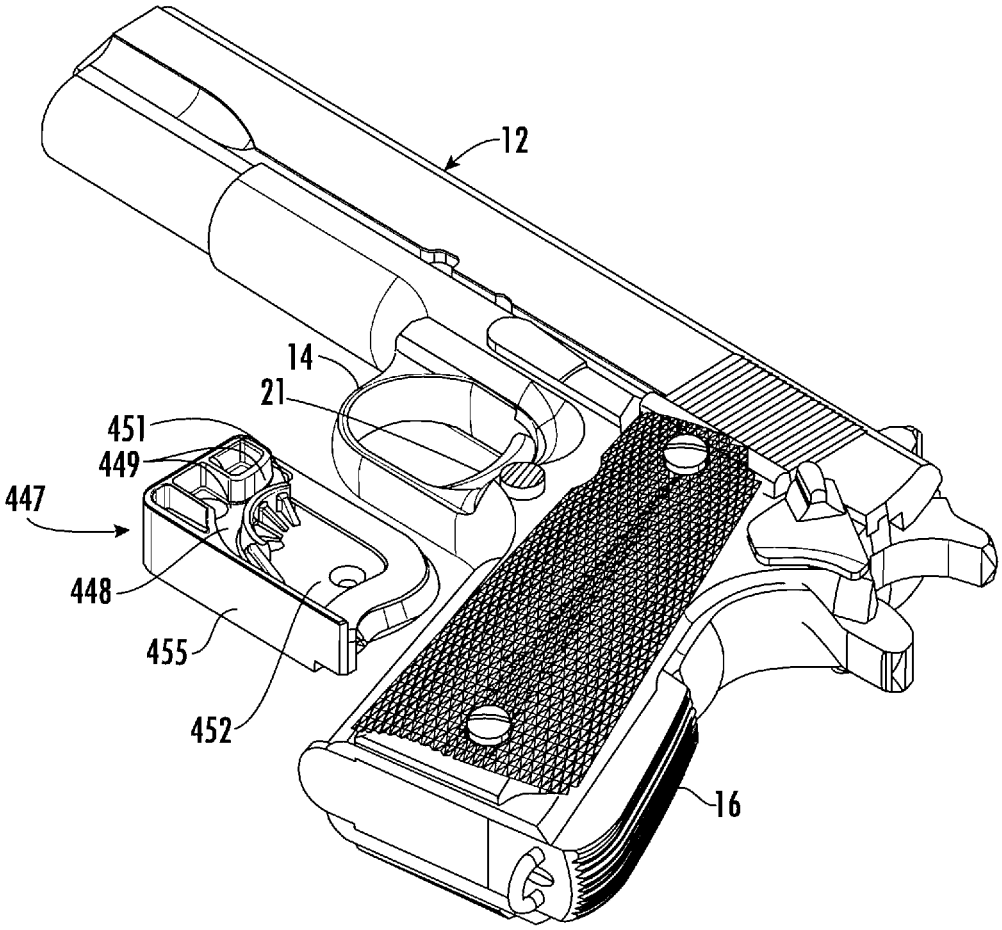
FIG. 11 is another fragmentary perspective view of the locking system of the trigger lock of FIG. 8.

As best seen in FIGS. 8-10, the gun safety device is a trigger lock 400 that includes both a mechanical and electronic means to unlock the trigger lock, allowing it to be removed from the trigger guard 14. The trigger lock 400 includes a housing 405 having a cover 406 and a base housing 407. The cover 406 includes a cover shroud 410 that is received over and secured to lid 411, which is hingedly mounted to tray 413, part of the base 407, via a torsion spring biased hinge arrangement 415 as described above in more detail for the other embodiments of the present invention. A compression spring could also be used. The hinge 415 and its related spring resiliently urge the cover 406 and base 407 to move relative to one another when the latching mechanism is released to move to an open configuration as seen in FIG. 10. The shroud 410 is suitably secured to the lid 411, as with an intermediate mounting plate 417 that can also include the user interface and the interrogator 62 antenna. The mounting plate 417 can include a series of switches 420 that align with pushbuttons 421 on the shroud, and are connected to a controller 423 that is mounted in the lid 411. The controller 423 controls operation of the latch assembly, designated generally 467. A base shroud 425 can be provided and attached to the tray 413, such as by screw fasteners or a snap lock connection. It is to be understood that the shrouds 410 and 425 can be made as a permanent portion of the cover 406 and base 407.

Figure 12:
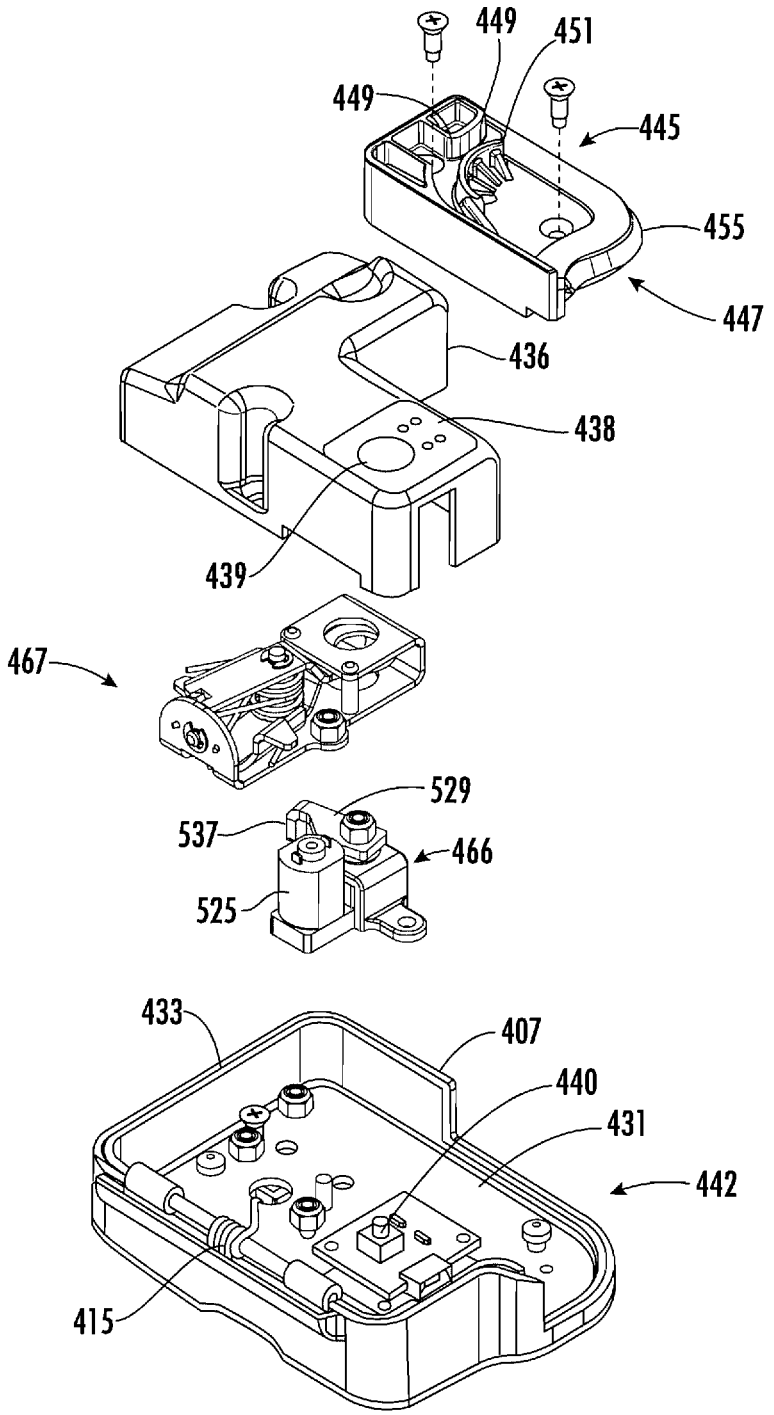
FIG. 12 is an exploded perspective view of a portion of the locking system of the trigger lock of FIG. 8.

Both the cover 406 and base 407 have hollow interiors or cavities in which portions of the trigger lock 400 can be contained and shielded from access. The base 407 can be best seen in FIG. 12. The cover 406 has a main panel 430, and the base 407 also has a main panel 431. The cover 406 has a flange 432 that extends around its periphery toward the base 407, and the base 407 has a flange 433 that extends around its periphery toward the cover 406. The cover 406 and base 407 can be made from formed metal, molded plastic or the like. The base 407 can also be provided with a closure panel 436 to close the top of the chamber formed by the flange 433 and main panel 431. It can be secured in place by any suitable means, such as screw fasteners or a snap lock arrangement. As seen in FIG. 12, the closure panel 436 can be provided with a battery condition indicator 438. The battery condition indicator 438 can be operated by a pushbutton 439 that in turn operates a switch 440 mounted in the base 407. The switch 440 is in turn operably connected to the controller 423 to provide a command to program the RFID in safe and show the battery condition on the indicator 438. This embodiment can utilize the power supply 69 as described above. An access opening is provided, and can be formed by a pair of notches, notch 441 in the cover 406 and notch 442 in the base 407. These notches provide an opening for accommodating the trigger guard 14 to enter the trigger lock 400. The notches 441, 442 form an opening into a trigger guard receiving receptacle 445, a portion of which is in each of the cover 406 and base 407. When a firearm 12 is secured in the trigger lock 400, the trigger guard 14 and trigger 21 are contained within the receptacle 445. The trigger guard receptacle 445 can be similar to those described for the other embodiments discussed above, such as receptacle 40.

Means is provided to resist removal of the firearm 12 from the trigger lock 400 when the cover 406 and base 407 are in their closed and locked configuration, as seen in FIGS. 8 and 9. As shown in the above embodiments, this trigger lock 400 includes a retainer 447 operably associated with at least one of the cover 406 and base 407 to retain the firearm 12 secured to the trigger lock 400 to the firearm. The retainer 447 uses one or more ribs 451 being mounted to the base 407 and, optionally, one or more being mounted to the cover 406. As shown, the ribs 451 are each part of a respective insert 450 and 455. Preferably, the inserts 450, 455 are removably mounted to their respective cover 406 or base 407. Removable inserts allow for changing the inserts to accommodate different shapes and sizes of trigger guards 14. The ribs 451 are sized and shaped to be received on the inside of the trigger guard 14 and conform generally to the interior shape of the inside surface of the trigger guard 14 and to resist withdrawal of a gun 12 when the trigger lock 400 is secured to the gun 12. The ribs 451 overlie and are in alignment with each other. The ribs 451 form a groove 448 between the rib 451 and the adjacent wall or wall portions 449. As shown, the ribs 451 extend upwardly from a wall 452 that forms part of a respective insert 450, 455. The inserts 450, 455 form a trigger guard receiving receptacle 453, like receptacle 40, 445.

Figure 13:
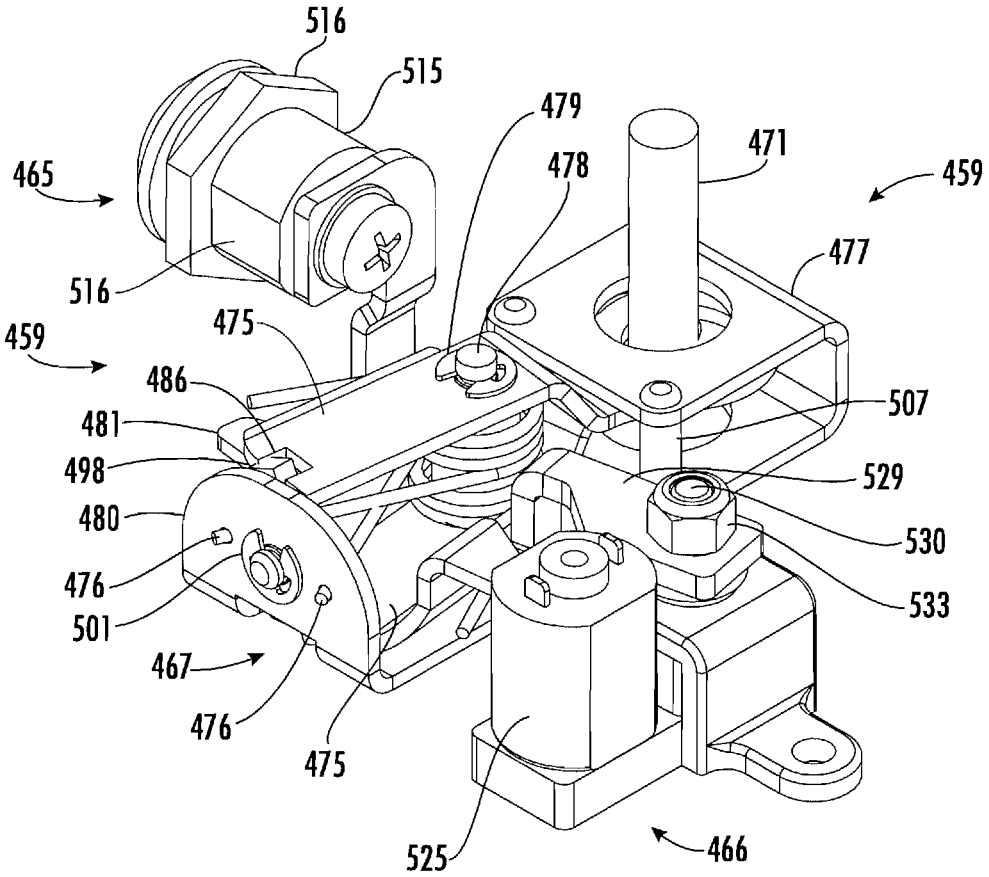
FIG. 13 is a perspective view of the latching mechanism of the trigger lock of FIG. 8.

FIGS. 12-17 show a locking system, designated generally 459, shown in detail in FIG. 13, which is another embodiment of the latch assemblies 70, 265 described above.

The present invention provides a dual, mechanical and electronic, cover opening system which releases the hand gun 12 from the trigger lock 400, making it available for use. The trigger lock 400 preferably utilizes an internal electrical source, such as a battery, such as battery 69 described above, to provide portability to the device; however, standard electrical current can be utilized without departing from the scope of the invention as described above. The safety device could also include a power switch or a sleep mode which activates, for example, an interrogator 62 for the RFID tag 60 for a predetermined amount of time to conserve battery power. The locking system 459 is contained in the housing 405.

The locking system 459 includes a dual catch release mechanism, one electronic and one mechanical, using a common latch assembly 467. A catch member 471 is part of the latch assembly 467, and is secured to the cover 406 and movable therewith. The trigger lock 400 is provided with a locking system 459 that includes a plurality of components. The locking system 459 includes a manual lock mechanism or actuator designated generally 465, an electronic release assembly or actuator designated generally 466, and a latch assembly designated generally 467. The mechanisms 465, 466, 467 cooperate with one another to effect locking the cover 406 in a closed configuration to retain the firearm 12, and unlocking the cover 406 to allow it to move to an open position and release the firearm. While the catch 471 is shown as secured to the cover 406 and the latch assembly 467 is shown as secured to the base 407, this mounting configuration could be reversed.

Figure 14:
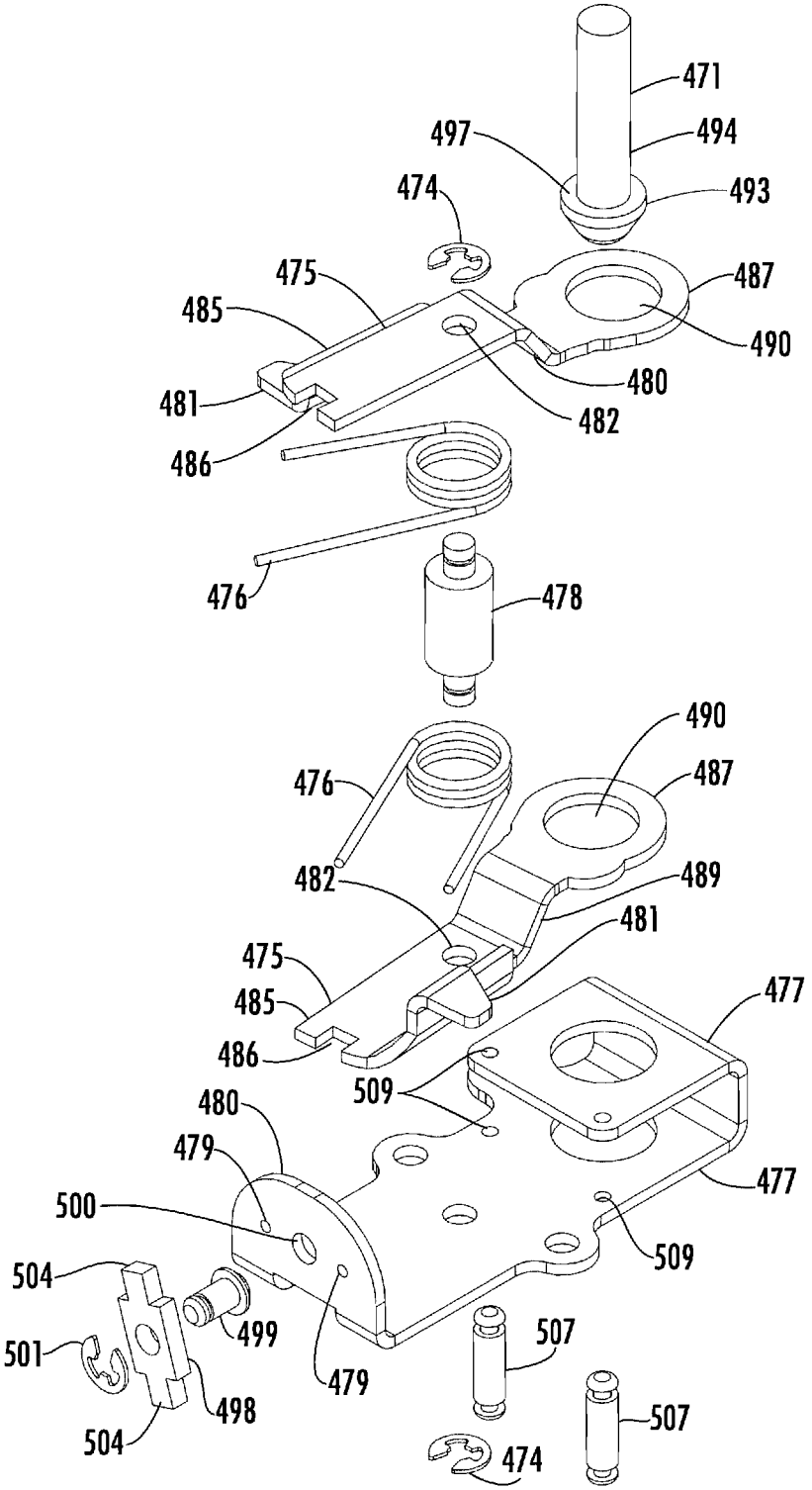
FIG. 14 is an exploded perspective view of a portion of the latching mechanism of FIG. 13.
Figure 15:
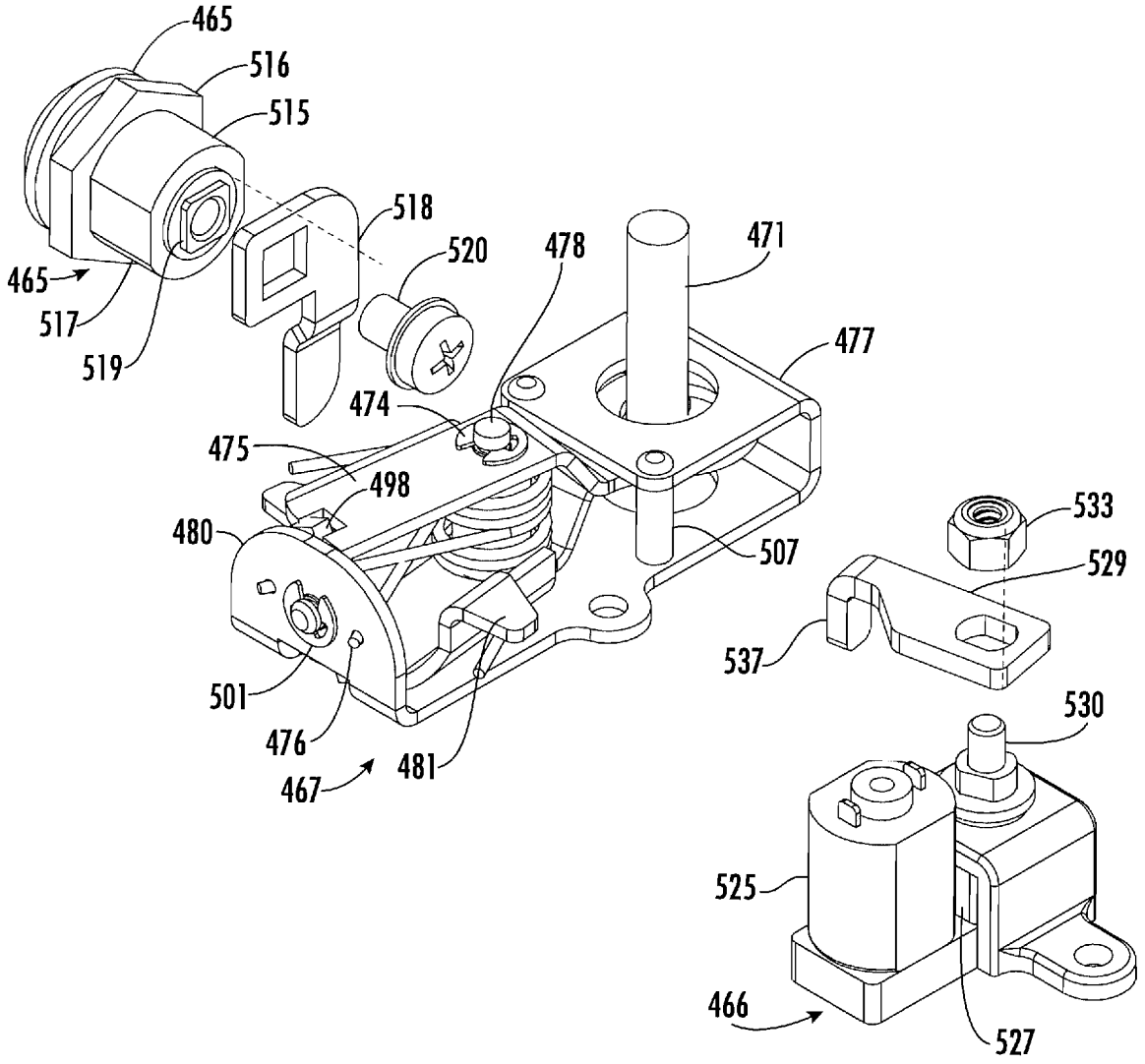
FIG. 15 is a partially exploded perspective view of the latching mechanism of FIG. 13.
Figure 16:
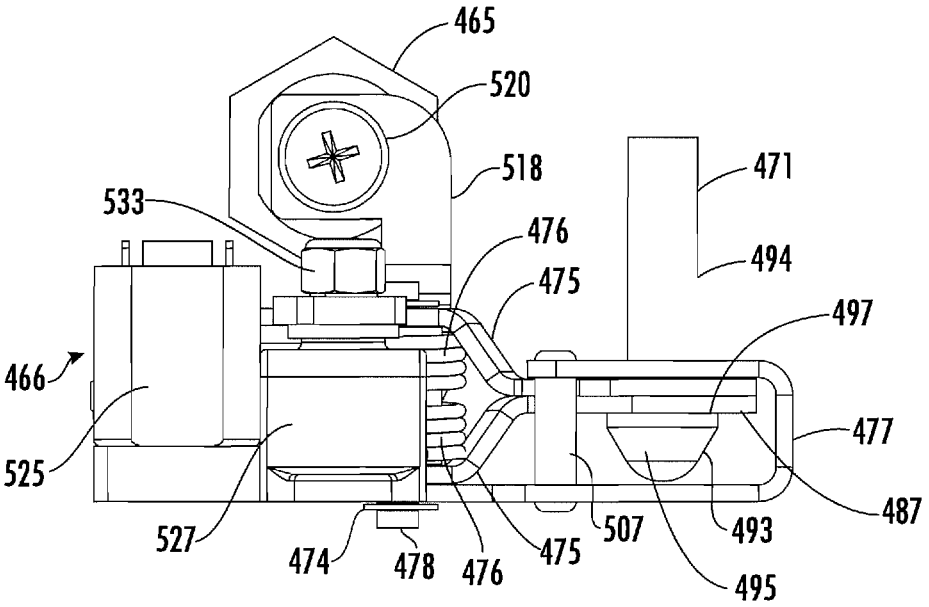
FIG. 16 is a side elevation view of the latching mechanism of FIG. 13, showing the latching mechanism in a latched condition.
Figure 17:
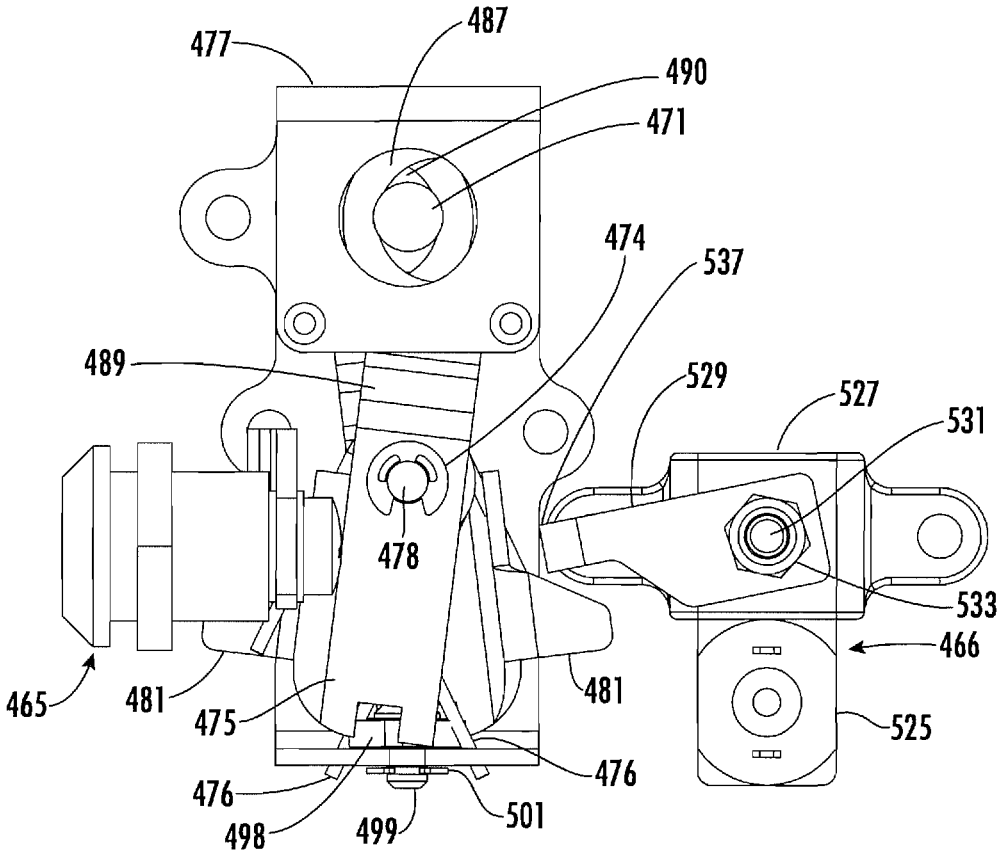
FIG. 17 is a plan view of the latching mechanism of FIG. 13, showing the latching mechanism in a latched condition.

The latch assembly 467 includes a pair of pawl member 475 which are pivotally mounted to a suitable support structure and are each resiliently biased to a latch position with a respective torsion spring 476. Preferably, the pawl members 475 can be the same, but one is inverted relative to the other in the latch assembly 467. As shown in FIG. 14, the pawl members 475 are mounted to a support 477 via a pivot pin 478 that can be held in place by E retaining clips 474. One end of each of the torsion springs 476 engages a respective foot 481 on each of the pawl members 475 to apply a resilient biasing force to each of the pawl members 475. The biasing forces urge the pawl members 475 to a closed or latching position for each of the pawl members 475, as seen in FIG. 17. The other end of each of the springs 476 extends through a respective hole 479 in a flange 480 to limit pivoting movement of the pawl members 475 on the pin 478 and provide the biasing force. The pawl members 475 are similar in size, shape and construction, and include through holes 482 for receipt of portions of the pin 478 therethrough to allow for pivoting movement of the pawl members 475 about the pin 478. The pawl members 475 each include a drive end arm portion 485 that, at one end, includes a notch 486 for a purpose later described. The foot 481 is positioned adjacent the drive end arm portion 485 projecting sideways therefrom. The pawl member 475 includes a latch end 487 connected to the drive end arm portion 485. A bight section 489 connects the drive end arm portion 485 to the latch end 487 such that the mounted pawl members 475 are spaced apart to allow clearance for the springs 476 to be positioned therebetween, while the latch ends 487 are immediately adjacent one another, as best seen in FIG. 16, and selectively engage one another if opening of the trigger lock 400 is attempted without unlatching. As shown, the bight section 489 is angled relative to the drive end arm portion 485 and respective latch end 487 to provide for the above described relative positions between the adjacent pawl members 475. The pawl members 475 each have a through hole 490 in the latch end 487 for receipt therethrough of the catch 471. See FIGS. 14, 16. The catch 471 includes a knob 493 that is attached to and preferably integral with a post 494. The post 494 is secured to either the cover 405 or the base 407, while the latch assembly 467 is secured to the other of the cover or base. The knob 493 has a tapered section 495 that tapers outwardly from its free end to provide a tapered lead-in for the knob 493 to pass through the through holes 490. A shoulder 497 is located on the backside of the knob 493, and is adapted to engage a lower surface of a latch end 487 when the cover 405 is in its closed and latched position. An edge of each of the holes 490 engages the post 494 when the pawl members 475 are in their latching positions, as shown in FIG. 17.

Means is provided to effect simultaneous movement of the pawl members 475 during their latching and unlatching movements. As shown, a seesaw type lever 498 is pivotally mounted on a pin 499 that extends through a through hole 500 in the flange 480. The pin 499 and lever 498 are held in place on the flange 480 by a suitable securement device, such as an E retainer clip 501. The lever 498 has opposite ends 504, each received within a respective notch 486 in the pawl members 475, whereby movement of one pawl member 475 will effect simultaneous opposite movement of the other pawl 475. The support 477 can be reinforced with pins 507 by extending through holes 509 on the support 477, and be secured in place by peening over ends thereof, or by use of push pins.

Both the mechanical and electronic actuators 465, 466, respectively, are provided to effect independent operation of the latching assembly 467. As seen in FIGS. 9, 10, the mechanical actuator 465 is mounted on the front of the trigger lock 400, and preferably mounted to the cover 405 and movable therewith. The mechanical actuator 465 includes a key lock 515 that is suitably secured to the cover 405, as for example, by extending through a hole therein and being secured in place, as for example, by a threaded nut 516. The key lock 515 can be of any suitable type, as described above for the key lock 64, and has a cylinder 517 that is preferably keyed to a hole in the cover 405, as for example, by having flat portions thereon. An arm 518 is mounted to the cylinder 517, preferably in a keyed manner to prevent relative rotation between the arm 518 and an output shaft 519 of the cylinder 517. The securement of the arm 518 to the cylinder 517 can be via a threaded fastener 520. The arm 518, when moved by operation of the lock 515, engages the adjacent foot 481 to effect movement of the respective pawl member 475 and the other pawl member 475 via movement of the lever 498 to a position where the holes 490 are aligned to release the catch 471 from retention, allowing the cover 405 to move to an open position. Rotation of the key lock 515 in an opposite direction allows the pawl members 475 to return to their latching position, as best seen in FIG. 17. The use of the mechanical actuator 465 provides a mechanical override to the electronic actuator 466.

The electronic actuator 466 includes a motor 525, which in turn will drive a coupled gear drive 527, such as a right angle drive. An arm 529 is mounted to an output shaft 530 of the drive 527 to effect rotation of the arm. The arm 529 can be secured to the output shaft 530, as for example by a threaded nut 533. The arm 529 includes a finger 537 that is positioned to engage a foot 481 of the adjacent pawl member 475 to effect its pivoting movement about the pin 478 when the motor 525 is turning. The rotating arm 529 effects movement of the lower pawl member 475, and the upper pawl member 475 also moves via operation of the lever 498. This moves the holes 490 into alignment to release the catch 471 and allow the cover 405 to move to its open position. Rotation reversal of the motor 525 will effect reverse rotation of the arm 529, allowing the latch 475 to move back to its latching position where the holes 490 are not in alignment, as seen in FIG. 17. This will allow the catch 471 to move into the holes 490 and effect rotation of the pawl members 475, and allow the knob 493 to pass therethrough and the cover 405 to be latched in its closed position. The pawl members 475 pivot in a plane generally perpendicular to the plane of movement of the catch 471 during opening and closing movement of the cover 405. It is to be understood that other means can be used to operably couple the motor 525 to the pawl member 475 to effect its movement. One such means could be a cable wrapped around the shaft 530.

Means is provided to stop both unlatching rotation of the motor 525 and latching rotation of the motor 525. This can be done by a pair of limit switches, one for each end of the needed rotational stroke of the arm 529, and the use of an encoder to let the controller 423 know when the end of the strokes have been reached and effect either turning off of the motor 525 or causing the motor 525 to reverse direction. Other means to control motor operation include a stepper motor, which would operate in essence like the encoder, a motor load indicator to indicate that the motor 525 has reached an end of its rotation to effect either rotation stoppage or rotation reversal, or a timer system controlling how long the motor rotates for latching and returning to its start position.

The electronic actuator 466 is actuated for operation as described above. A signal is sent to the electronic actuator via some biometric input, such as voice input, fingerprint reading, RFID input or the like, that signals the motor 525 to start and then stop through at least partial control by the controller 423. The above-described embodiments can also utilize the same motor rotation actuation and limitation means. It is to be understood that a code can be entered using the keypad comprising the buttons 421 to also effect opening of the trigger lock 400 as described above.

Figure 18:
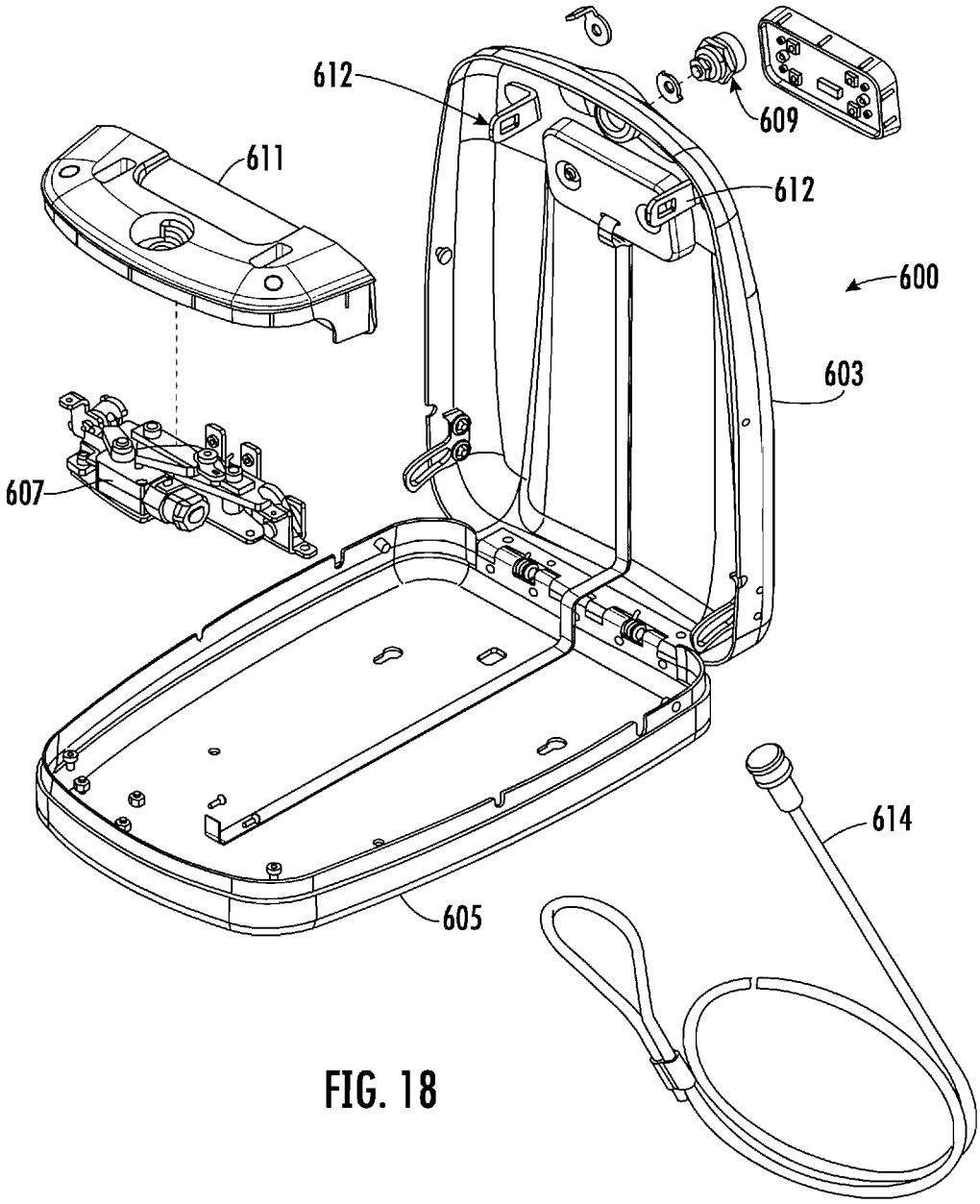
FIG. 18 is a perspective view of a firearm storage case adapted for using the herein described latching mechanisms.

FIG. 18 illustrates another form of firearm safety device that can utilize the above latching and control mechanisms. Such safety devices conceal at least a portion of the trigger guard and trigger, making them inaccessible. Instead of being a trigger lock, the safety device 600 is a firearm storage box that can hold a firearm within a chamber formed by a cover 603 and the base housing 605. The safety device 600 includes a locking system 607 similar to the locking system 459 described above, or one of the other locking systems as described above. It also includes a key lock override 609 and a battery indicator 611. The device 600 includes catches 612, or a single catch similar to catch 471 disclosed above. It can also include a cable tether 614 to secure the safety device 600 to a bed or the like. Such a safety device is disclosed in co-pending application, U.S. Nonprovisional patent application Ser. No. 14/174,527, filed Feb. 6, 2014, entitled, "HANDGUN MINI-VAULT", now U.S. Pat. No. 9,561,266, issued Dec. 27, 2016, the disclosure of which is incorporated herein in its entirety by reference.

It is to be understood that while a certain form of the invention is illustrated, it is not to be limited to the specific form or arrangement herein described and shown. It will be apparent to those skilled in the art that various changes may be made without departing from the scope of the invention, and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary, and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A firearm safety device adapted to secure at least a portion of a firearm when latched, said device including:

a base housing;

a cover removably connected to said base housing, said cover being selectively movable between an unlatched position and a latched position;

a locking system including a manual lock actuator, an electronic lock actuator and a latch mechanism in cooperative association with one another to effect selective locking of the cover in a latched position and, upon unlocking using either the manual lock actuator or electronic lock actuator, the locking system is operable to allow the cover to move to an unlatched position;

at least one catch mounted to one of the cover and the base housing;

said latch mechanism mounted to the other of the base housing and cover, said latch mechanism being operable to engage said catch and releasably retain said cover in the latched position, the latch mechanism including a pair of pawl members which are pivotally mounted to a suitable support structure and are each resiliently biased to a latch position with a respective spring to apply a resilient biasing force to each of the pawl members to engage the catch on opposite sides with respect to each other, the pawl members each including a drive end arm portion at one end and a through hole in an opposing latch end for receiving the catch therethrough, at least one of the pair of pawl members including a foot member positioned adjacent the drive end arm portion projecting sideways therefrom for rotating one of the pawl members to the unlatched position utilizing the locking system, the pawl members being mechanically connected to each other so that rotation of one pawl member causes a rotation of the other pawl member in an opposite direction.

2. The firearm safety device of claim 1 including a trigger guard receiving receptacle between the base housing and cover sized and shaped to receive a trigger guard therein between a first wall carried by the cover and a second wall carried by the base housing, a rib extending from at least one of the first wall and second wall and forming a trigger guard receiving groove sized and shaped for receiving a trigger guard therein and releasably retain a trigger guard therein when the cover is in a closed position, wherein the rib and respective said first or second wall being part of an insert removably mounted to a respective said base housing or said cover.

3. The firearm safety device of claim 2 wherein said insert including a third wall extending from a respective said first or second wall and spaced from a respective said rib partially defining a respective said groove.

4. The firearm safety device of claim 3 wherein the insert being mounted to said base housing.

5. The firearm safety device of claim 4 wherein there being a said insert mounted to both the cover and the base housing and said grooves and ribs overlying one another.

6. The firearm safety device of claim 2 wherein the locking system including an RFID interrogator mounted in the safety device and including at least one RFID tag operable to provide a signal to the RFID interrogator to effect operation of the electronic lock actuator to effect operation of the latching mechanism and permit the cover to move to an open position.

7. The firearm safety device of claim 1 wherein the locking system including an RFID interrogator mounted in the safety device and including at least one RFID tag operable to provide a signal to the RFID interrogator to effect operation of the electronic lock actuator to effect operation of the latching mechanism and permit the cover to move to an open position.

8. A firearm safety device adapted to secure at least a portion of a firearm when closed and latched, said device including:

a base housing;

a cover hingedly connected to said base housing, said cover being selectively movable between an open position and a closed position;

a locking system including a manual lock actuator, an electronic lock actuator and a latch mechanism in cooperative association with one another to effect selective locking of the cover in a closed position and, upon unlocking using either the manual lock actuator or electronic lock actuator, the locking system is operable to allow the cover to move to an open position, the locking system further including an RFID interrogator mounted in the safety device and at least one RFID tag operable to provide a signal to the RFID interrogator to effect operation of the electronic lock actuator to effect operation of the latching mechanism and permit the cover to move to an open position;

at least one catch mounted to one of the cover and the base housing;

said latch mechanism mounted to the other of the base housing and cover, said latch mechanism being operable to engage said catch and releasably retain said cover is a closed position, said latch mechanism including a pair of pawl member which are pivotally mounted to a suitable support structure and are each resiliently biased to a latch position with a respective spring to apply a resilient biasing force to each of the pawl members to engage the catch from different sides with respect to each other, the pawl members each including a drive end arm portion at one end and a through hole in an opposing latch end for receiving the catch therethrough, at least one of the pair of pawl members including a foot member positioned adjacent the drive end arm portion projecting sideways therefrom for rotating one of the pawl members to the unlatched position utilizing the locking system, the pawl members being mechanically connected to each other so that rotation of one pawl member causes a rotation of the other pawl member in an opposite direction.

9. The firearm safety device of claim 8 wherein each drive end arm portion includes a notch, the notch sized and shaped to cooperate with a seesaw lever, the seesaw lever being pivotally mounted on a pin to allow rotation about the pin, the seesaw lever having opposite ends, each received within a respective notch in each pawl member, wherein movement of one pawl member will effect simultaneous opposite movement of the other pawl.

10. The firearm safety device of claim 8 wherein the catch includes a knob that is attached to a post, the knob having a tapered section that tapers outwardly from its free end to provide a tapered lead-in for the knob to pass through the through holes, a shoulder is located on the backside of the knob, and is adapted to engage a lower surface of a latch end when the cover is in its closed and latched position.

* * * * *